US008925614B2

(12) United States Patent
Okachi et al.

(10) Patent No.: US 8,925,614 B2
(45) Date of Patent: Jan. 6, 2015

(54) SCREEN DEVICE

(75) Inventors: Yasubumi Okachi, Yokohama (JP); Mitsuharu Watanabe, Yokohama (JP)

(73) Assignee: Metaco Inc., Tokyo (JP)

( * ) Notice: Subject to any disclaimer, the term of this patent is extended or adjusted under 35 U.S.C. 154(b) by 131 days.

(21) Appl. No.: 13/500,437

(22) PCT Filed: Oct. 7, 2010

(86) PCT No.: PCT/JP2010/067684

§ 371 (c)(1),
(2), (4) Date: Jun. 13, 2012

(87) PCT Pub. No.: WO2011/043437

PCT Pub. Date: Apr. 14, 2011

(65) Prior Publication Data

US 2012/0247690 A1 Oct. 4, 2012

(30) Foreign Application Priority Data

Oct. 7, 2009 (JP) ..... 2009-233913

(51) Int. Cl.
*E06B 9/54* (2006.01)

(52) U.S. Cl.
CPC ..... *E06B 9/54* (2013.01); *E06B 2009/543* (2013.01)
USPC ..... 160/31; 160/84.06

(58) Field of Classification Search
CPC ..... E06B 9/54; E06B 9/34; E06B 9/58; E06B 2009/543
USPC ..... 160/84.06, 245, 121.1, 120, 277, 243, 160/244, 265, 270, 201, 271, 272, 194, 160/268.1
See application file for complete search history.

(56) References Cited

U.S. PATENT DOCUMENTS 5,377,737 A * 1/1995 Moriya et al. ..... 160/84.06
6,186,212 B1 * 2/2001 Tsuchida ..... 160/84.06

(Continued)

FOREIGN PATENT DOCUMENTS

JP 8-28160 1/1996
JP 3323461 6/2002

(Continued)

OTHER PUBLICATIONS

International Search Report issued Nov. 2, 2010 in corresponding International Application No. PCT/JP2010/067684.

*Primary Examiner* — Katherine Mitchell
*Assistant Examiner* — Johnnie A Shablack
(74) *Attorney, Agent, or Firm* — Wenderoth, Lind & Ponack, LLP

(57) ABSTRACT

A screen device including first rigid units (24) which constitute an upper slide guide frame portion (15) and second rigid units (17) which constitute a lower slide guide frame portion (16). The upper slide guide frame portion and the lower slide guide frame portion are retractable into the interior of a screen mounting frame (10). Wall portions (18) of the first rigid units are fitted in between the side wall portions of the second rigid units, and the upper slide guide frame portion intersects the lower slide guide frame portion in the interior of the screen mounting frame. Connection of the first rigid units can be released at an arbitrary position in the interior of the screen mounting frame when adjusting the length of the screen device (1), and the upper slide guide frame portion can be taken out from the screen mounting frame, so that an adjustment of the length in the field of installation is facilitated.

14 Claims, 8 Drawing Sheets

(56) References Cited

U.S. PATENT DOCUMENTS

| | | | | |
|---|---|---|---|---|
| 6,318,438 | B1 * | 11/2001 | Uno et al. | 160/31 |
| 6,938,667 | B2 * | 9/2005 | Sugiyama et al. | 160/296 |
| 6,978,820 | B2 * | 12/2005 | Aoki | 160/84.06 |
| 7,395,850 | B2 * | 7/2008 | Chino et al. | 160/243 |
| 7,472,738 | B2 * | 1/2009 | Kamosawa et al. | 160/84.06 |
| 7,669,632 | B2 * | 3/2010 | Moriya et al. | 160/31 |
| 7,694,711 | B2 * | 4/2010 | Okachi et al. | 160/245 |
| 7,717,152 | B2 * | 5/2010 | Moriya et al. | 160/31 |
| 7,810,542 | B2 * | 10/2010 | Bonini | 160/31 |
| 7,810,543 | B2 * | 10/2010 | Donatelli et al. | 160/31 |
| 7,931,070 | B2 * | 4/2011 | Chino et al. | 160/194 |
| 7,963,312 | B2 * | 6/2011 | Okachi et al. | 160/31 |
| 7,984,744 | B2 * | 7/2011 | Karasawa et al. | 160/84.06 |
| 8,191,601 | B2 * | 6/2012 | Okachi et al. | 160/122 |
| 8,196,638 | B2 * | 6/2012 | Roberts et al. | 160/84.06 |
| 8,316,912 | B2 * | 11/2012 | Okachi | 160/84.06 |
| 2008/0135189 | A1 | 6/2008 | Okachi et al. | |
| 2009/0020234 | A1 * | 1/2009 | Chino et al. | 160/31 |
| 2010/0096093 | A1 * | 4/2010 | Okachi et al. | 160/313 |
| 2011/0203752 | A1 * | 8/2011 | Okachi | 160/372 |
| 2012/0247690 | A1 * | 10/2012 | Okachi et al. | 160/239 |

FOREIGN PATENT DOCUMENTS

| | | |
|---|---|---|
| JP | 3403652 | 2/2003 |
| JP | 2005-351046 | 12/2005 |

* cited by examiner (a)

(b)

SCREEN DEVICE

BACKGROUND OF THE INVENTION

1. Technical Field

The present invention relates to a screen device which can be used mainly as a curtain and a blind, and also as a screen window and a partition.

2. Description of the Related Art

The present applicant proposes a multi-purpose screen device described in Japanese Patent No. 3323461. The present applicant has also developed some variations on the basis of the above-described screen device.

Those screen devices include a pair of slide guide frames which are withdrawn and retracted in the directions of opening and closing of the screen. The slide guide frames each include a plurality of rigid units coupled to each other so as to be rotatable between the adjacent two units, and are configured to be bendable in one direction and not to be bendable in the other direction to maintain its linearity.

Also, a screen device disclosed in JP-A-2005-351046 includes a roller pipe having a coil spring integrated therein, and is configured in such a manner that one end portion of the screen is fixed to the roller pipe, and the screen can be wound around the roller pipe and withdrawn therefrom at the time of opening and closing, so that a smooth and stable opening and closing operation is achieved.

SUMMARY OF THE INVENTION

1. Problems to be Solved by the Invention

The screen devices described above are used in multi purposes owing to its superior opening-and-closing operability and workability. However, there are some variations in size of openings or the like in buildings where the screen devices are to be installed although it is standardized to some extent. If screen devices corresponding to all those variations are manufactured, the screen device becomes a multiple product, and hence there arise problems in stable supply and stock control of the product. In addition, the sizes of the openings or the like in buildings often vary depending on how they are built, and hence adjustment in the field of installation is obliged in many cases even when they are standardized. In particular, in the case of side sliding screen devices, adjustment of length is needed.

Also, in general, the screen devices are delivered in a state in which principal portions are assembled in manufacturing facilities considering quality stabilization or the like. Therefore, when performing adjustment in the field of installation, it is necessary to disassemble the assembled units, cut screen mounting frames, screens, roller pipes and the like, and then assemble the same again, so that execution of work is complicated.

In view of such circumstances, it is an object of the present invention to provide a screen device which achieves an easy length adjustment work, in which the lengthwise dimension can be adjusted easily by cutting in the field of installation.

2. Means for Solving the Problems

In order to solve the above described problems, the present invention has following characteristics.

A first invention is a screen device including: a screen to be opened and closed sideward; a roller pipe to which one of left and right ends of the screen is attached, the roller pipe configured to be rotated by an elastic force of an integrated coil spring and wind the screen on an outer periphery thereof; a screen mounting frame being slidable in the direction of opening and closing of the screen with respect to the roller pipe fixed to a predetermined position, to which one end of the screen positioned on the opposite side from the end attached to the roller pipe is attached; and an upper slide guide frame portion disposed in the vicinity of an upper end of the screen and a lower slide guide frame portion disposed in the vicinity of a lower end of the screen, wherein the upper slide guide frame portion is made up of a plurality of first rigid units each having a pair of side wall portions arranged so as to face each other and a bridging portion connecting both side wall portions with respect to each other by being connected so as to be rotatable between the adjacent two units, the lower slide guide frame portion is made up of a plurality of second rigid units each having a pair of side wall portions arranged so as to face each other and a bridging portion connecting the both side wall portions with respect to each other by being connected so as to be rotatable between the two adjacent units, the upper slide guide frame portion and the lower slide guide frame portion both have flexibility and each have a free end at one end thereof, the free end being able to be retracted into and withdrawn from the interior of the screen mounting frame, portions withdrawn from the screen mounting frame in association with the sliding movement of the screen mounting frame keeping their linearity when being withdrawn from the screen mounting frame, characterized in that the size of the first rigid unit is smaller than the size of the second rigid unit, and when the upper slide guide frame portion and the lower slide guide frame portion are retracted into the interior of the screen mounting frame, the side wall portions of the first rigid units are fitted into the inner side of the side wall portions of the second rigid units, and the upper slide guide frame portion intersects the lower slide guide frame portion in the interior of the screen mounting frame.

In the characteristics of the first invention described above, the second invention is characterized in that the free ends of the upper slide guide frame portion and the lower slide guide frame portion are connected by a tension member forming a loop in the interior of the screen mounting frame, fold back members for folding back the tension member are disposed at upper and lower two positions in the screen mounting frame, and the upper fold back member is arranged at a position lower than a cutting position of the screen device.

In the characteristics of the first or second invention described above, the third invention is characterized in that the screen mounting frame includes a slot which allows insertion of a fixing member disposed at an end portion of the screen at a position where the screen is mounted, and the slot is formed with notches formed by cutting both left and right sides thereof so as to increase the width thereof at a lower end portion of the screen mounting frame.

In the characteristics of the third invention described above, the fourth invention is characterized in that upper ends of the screen and the roller pipes are arranged at the same position.

In the characteristics in any one of first to fourth inventions described above, the fifth invention is characterized in that a latch is disposed on an architrave facing the screen mounting frame at an opening where the screen device is installed, a hanger configured to engage the latch on a front surface portion of the screen mounting frame facing the architrave, and the hanger is formed with insertion grooves for a tool at both upper and lower end portions thereof.

3. Advantages of the Invention

According to the first invention described above, since the lower slide guide frame portion made up of the larger second rigid units can be retracted into the interior of the screen mounting frame, the upper slide guide frame portion made up of the smaller first rigid units can be retracted into the interior of the screen mounting frame with a space allowance with respect to the screen mounting frame. Therefore, connection between the second rigid units can be released by inserting a tool such as a screw driver into the interior of the screen mounting frame. When adjusting the length of the screen device, the upper slide guide frame portion positioned on the cutting side can be taken out from the interior of the screen mounting frame, and the taking out operation is easy because it can be performed at an arbitrary position of the upper slide guide frame portion. Therefore, the length adjustment work on the screen device is facilitated.

According to the second invention described above, in addition to the advantage of the first invention described above, even when the tension member configured to connect the upper slide guide frame portion and the lower slide guide frame portion at the free end side and applying the tension thereto respectively is folded back and forms the loop in the interior of the screen mounting frame, since the fold back member positioned on the upper side is arranged at a position lower than the cutting position of the screen device, the tension member does not work against the length adjustment work on the screen device, so that the length adjustment work is facilitated.

According to the third invention described above, in addition to the advantage of the first or second invention, since the slot which allows insertion of the fixing member disposed at the end portion of the screen is formed with the notches formed by cutting the both left and right sides so as to increase the width at the lower end portion of the screen mounting frame, the screen can be pulled downward using the tool such as the screw driver, so that the upper ends of the screen mounting frame and the screen can be aligned at the same position easily when adjusting the length of the screen device. Both the screen mounting frame and the screen can be cut at a time, so that the length adjustment work on the screen device is further facilitated.

According to the fourth invention described above, in addition to the advantages in the third invention described above, the upper ends of the screen and the roller pipe are arranged at the same position, the roller pipe can also cut at a time with the screen mounting frame and the screen, so that the length adjustment work on the screen device is further facilitated.

According to the fifth invention described above, in addition to the advantage in any one of the first to fourth inventions described above, in the screen device kept in the closed state by the engagement between the latch and the hanger, since the hanger is formed with the insertion grooves for the tool at the both upper and lower end portions, the cover attached to the upper and lower sides of the hanger can be detached easily by inserting the tool such as the screw driver into the insertion grooves. When taking out the upper slide guide frame portion from the interior of the screen mounting frame in the length adjustment work of the screen device, the cover can be detached easily and hence the length adjustment work of the screen device can further be facilitated.

DETAILED DESCRIPTION OF THE INVENTION

Figure 1:
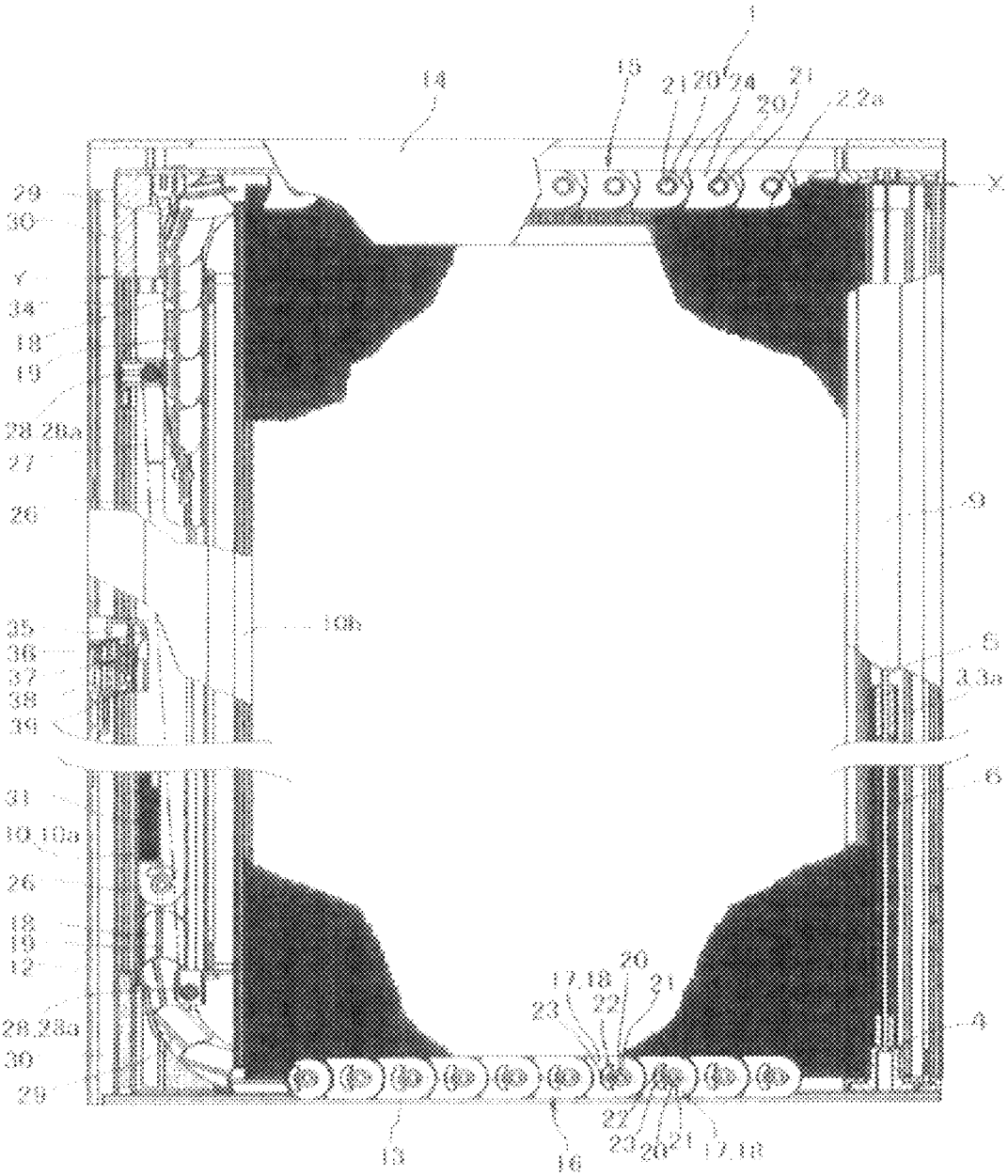
FIG. 1 is a vertical cross-sectional view showing an embodiment of a screen device according to the present invention.
Figure 2:
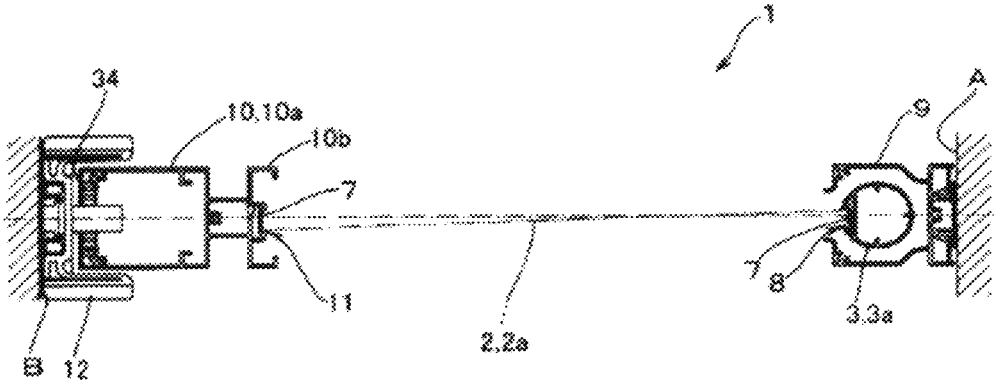
FIG. 2 is a lateral cross-sectional view of the screen device shown in FIG. 1.

As described above, FIGS. 1 and 2 are a vertical cross-sectional view and a lateral cross-sectional view showing an embodiment of a screen device of the present invention, respectively. On the other hand, FIGS. 3(*a*) and 3(*b*) are cross-sectional views of a principal portion showing a state in which an upper slide guide frame portion and a lower slide guide frame portion of the screen device shown in FIG. 1 are retracted into a screen mounting frame respectively, and FIG. 4 is a plan view of a principal portion showing the upper slide guide frame portion shown in FIG. 3 with connection and disconnection of first rigid units.

A screen device 1 includes a net 2*a* as a screen 2 to be opened and closed sideward. The screen 2 is formed of a cloth such as woven fabric or a knitted fabric, and is selected as needed according to required characteristics such as those having a light proof property or those usable as mosquito screening. In this embodiment, the net 2*a* applied as the mosquito screening is employed. Also, plaiting can be applied as needed irrespective of the shape of the screen 2 including the net 2*a*.

A right end of the screen 2 is attached to a roller pipe 3 arranged vertically and, for example, to be fixed to an architrave A on the right side of an opening formed into a rectangular shape and extending in the vertical direction in a building.

The roller pipe 3 includes a substantially cylindrical shaped hollow main body 3*a* and a bearing 4 to which the main body 3*a* is connected thereto at a lower end portion thereof. Disposed in the interior of the main body 3*a* is a revolving shaft 5, and the revolving shaft 5 extends from the bearing 4 to a midpoint of the roller pipe 3 in the height direction. Also, a coil spring 6 is integrated in the main body 3*a* and the coil spring 6 is arranged around the revolving shaft 5. An elastic force is stored in the coil spring 6 when twisted, and when the stored elastic force is released, the main body 3*a* rotates automatically about the revolving shaft 5. At this time, the screen 2 attached at one end thereof to the roller pipe 3 is wound around an outer periphery of the main body 3*a*. When the wound screen 2 is withdrawn in the closing direction, the main body 3*a* of the roller pipe 3 rotates in the opposite direction from the direction described above, the coil spring 6 is twisted, and an elastic force is stored.

Elongated fixing members 7 extending in the vertical direction are disposed on both left and right end portions of the screen 2. The main body 3*a* of the roller pipe 3 is formed with a slot 8 extending in the vertical direction, and the slot 8 is opened outward of the main body 3*a*. The screen 2 is attached to the roller pipe 3 at a right end thereof by the fixing member 7 inserted into the slot 8. Incidentally, both upper ends of the screen 2 and the roller pipe 3 are arranged in alignment at the same position as indicated by an arrow X in FIG. 1.

Also, the roller pipe 3 is accommodated in the interior of a hollow housing frame 9, and the housing frame 9 is fixed to the architrave A on the right side of the opening of the building.

A left end of the screen 2 is attached to a screen mounting frame 10 which is slidable with respect to the roller pipe 3 in the direction of opening and closing of the screen 2. The screen mounting frame 10 includes a hollow main body 10*a* in a square tube shape having a square cross section, and a screen mounting portion 10*b* positioned on the side of the roller pipe 3 and projecting rightward, and is arranged in the vertical direction. The screen mounting portion 10*b* has a substantially angular U-shaped cross-section, and is opened rightward. Also, the screen mounting portion 10*b* is formed with a slot 11 on an inner side surface opposing the roller pipe 3. The screen 2 is attached to the screen mounting frame 10 by the fixing member 7 disposed on the left end portion thereof inserted into the slot 11. A door stop frame 12 is disposed on an architrave B extending in the vertical direction on the left side of the opening of the building, and the screen mounting frame 10 is slidable between the door stop frame 12 and the housing frame 9 sideward. The screen 2 is openable and closable by the sliding movements of the screen mounting frame 10 as described above.

The screen device 1 also includes a lower rail 13 disposed on, for example, a floor surface, and an upper rail 14 on an upper architrave extending in the lateral direction of the opening of the building so as to achieve smooth sliding movements of the screen mounting frame 10. The lower rail 13 is formed to have, for example, an elongated rod shape. The upper rail 14 may be formed into, for example, a frame having an angular U-shape in cross section. In this case, the upper rail 14 can cover upper end portions of the screen mounting frame 10, the screen 2, and the roller pipe 3 from both front and back sides of the screen device 1, and contributes to an improved appearance of the screen device 1.

When opening and closing the screen 2, an operator can place his/her hand on the screen mounting frame 10 and slide the screen mounting frame 10 sideward, and the screen mounting frame 10 is guided from the inside by the lower rail 13, and is guided from the outside by the upper rail 14 and hence is slid sideward smoothly in the opening of the building. The screen mounting frame 10 can be provided with a hand grip on a front surface portion thereof, and also with a hand grip as needed on a back surface portion thereof, so as to facilitate opening and closing operations by the operator.

In the screen device 1, an upper slide guide frame portion 15 is disposed near an upper end of the screen 2, and a lower slide guide frame portion 16 is disposed near a lower end of the screen 2. Also, both the upper slide guide frame portion 15 and the lower slide guide frame portion 16 serve to arrange the screen mounting frame 10 in parallel to the roller pipe 3, and maintain the parallel positional relationship with respect to the roller pipe 3 also at the time of sliding movements of the screen mounting frame 10, thereby ensuring the opening and closing of the screen 2. The slide guide frame portions disclosed in U.S. Pat. No. 3,403,652 and U.S. Pat. No. 3,323,461 of the present applicant are applied to the upper slide guide frame portion 15 and the lower slide guide frame portion 16 as described above.

In other words, the lower slide guide frame portion 16 is made up of a plurality of second rigid units 17 connected so as to be rotatable between the adjacent two units. The second rigid unit 17 includes a pair of side wall portions 18 arranged so as to face each other, and a bridging portion 19 connecting both the side wall portions 18 at a position near an upper end portion of the side wall portion 18 from a substantially center portion to a right end portion. The side wall portion 18 is formed with a projection 20 at a left end portion thereof so as to project outward and a through hole 21 which allows engagement of the projection 20 therewith at a right end portion thereof and penetrates through the side wall portion 18 from the front to the back. The plurality of the second rigid units 17 are connected by inserting the projection 20 into the through hole 21 from the back side of the side wall portion 18 between the adjacent two units, thereby forming the lower slide guide frame portion 16. Also, since the projection 20 engages the through hole 21, the second rigid units 17 are rotatable with respect to each other between the adjacent two units, and the lower slide guide frame portion 16 has flexibility in conjunction with this rotation.

In addition, the second rigid unit 17 includes a small projection 22 projecting outward from the side wall portion 18 on the left side of the projection 20, and a substantially croissant shaped elongated hole 23 formed in the side wall portion 18 on the left side of the through hole 21 so as to be penetrated therethrough from the front to the back. The elongated hole 23 is capable of receiving the small projection 22, and when connecting the second rigid units 17, the small projection 22 is inserted into the interior of the elongated hole 23. Since the small projection 22 is inserted into the elongated hole 23 in this manner, between the adjacent two second rigid units 17, the rotation of the second rigid unit 17 is restricted when the small projection 22 comes into contact with one end of the elongated hole 23. Therefore, the lower slide guide frame portion 16 can keep its linearity.

The upper slide guide frame portion 15 is configured basically in the same manner as the lower slide guide frame portion 16. In other words, a first rigid unit 24 includes the pair of side wall portions 18 arranged so as to face each other and the bridging portion 19 connecting the side wall portions 18, and the side wall portion 18 is provided with the projection 20 and formed with the through hole 21. The upper slide guide frame portion 15 is made up of a plurality of the first rigid units 24 connected by inserting the projection 20 into the through hole 21 between the adjacent two units. The upper slide guide frame portion 15 also has flexibility in the same manner as the lower slide guide frame portion 16.

In contrast, the small projection 22 and the through hole 23 are omitted on the first rigid units 24 which constitute the upper slide guide frame portion 15. Instead, the first rigid unit 24 is provided with a shoulder 25 formed by notching the surface on a right end edge portion of the bridging portion 19. Between the two adjacent first rigid units 24, a left end portion of the bridging portion 19 of one of the first rigid units 24 is configured to be capable of overlapping with the shoulder 25 formed on the right end edge portion of the bridging portion 19 of the other first rigid unit 24, whereby the rotation of the first rigid unit 24 is restricted when being overlapped with each other. Therefore, the upper slide guide frame portion 15 is also capable of keeping its linearly in the same manner as the lower slide guide frame portion 16.

Incidentally, the upper slide guide frame portion 15 is capable of bending downward, and the lower slide guide frame portion 16 is capable of bending upward.

The first rigid units 24, the second rigid units 17 which constitute the upper slide guide frame portion 15, the lower slide guide frame portion 16 may be formed of materials having good formability such as resin, and metal. Also, when being formed of resin or metal, the side wall portion 18 on the right side can be opened outward by its elasticity as shown in FIG. 4, and in addition, can be restored spontaneously to its original state. Therefore, connection and disconnection of the plurality of first rigid units 24 and second rigid units 17 are easy.

Also, the upper slide guide frame portion 15 and the lower slide guide frame portion 16 both have a fixed end at right ends thereof, and are fixed to the roller pipe 3 side. In contrast, left ends are free ends 26, and are arranged in the interior of the main body 10*a* of the screen mounting frame 10, so that the upper slide guide frame portion 15 and the lower slide guide frame portion 16 are configured to be capable of being retracted into and withdrawn from the interior of the main body 10*a* of the screen mounting frame 10.

At the free ends 26, the upper slide guide frame portion 15 and the lower slide guide frame portion 16 are connected to each other by a tension member 27 selected from suitable materials such as a cord or a wire. The amounts of movement of the upper slide guide frame portion 15 and the lower slide guide frame portion 16 to the outside and to the inside of the main body 10*a* in association with the sliding movement of the screen mounting frame 10 are substantially equal by the connection using the tension member 27, and hence the parallel movement of the screen mounting frame 10 with respect to the roller pipe 3 is further ensured. The tension member 27 is formed into a loop in the interior of the main body 10*a* of the screen mounting frame 10, and is folded backward at both of the upper and lower sides of the screen mounting frame 10.

Fold back members 28 are disposed at two positions at upper and lower portions in the interior of the screen mounting frame 10 where the tension member 27 is folded back. The fold back members 28 each may be configured as a member including a pulley 28*a* and the like having a curved surface of a hand drum shape which allows the tension member 27 to be wound thereon.

In addition, in the screen mounting frame 10, guide blocks 30 are disposed at both upper and lower end portions thereof where the upper slide guide frame portion 15 and the lower slide guide frame portion 16 move forward and backward, and the guide blocks 30 each have a guide surface 29 for guiding bending of the upper slide guide frame portion 15 and the lower slide guide frame portion 16 on the inner side thereof. The guide blocks 30 are connected to both upper and lower ends of the main body 10*a* of the screen mounting frame 10. The upper guide block 30 has the guide surface 29 bent into a concave shape from the right end toward the lower end, and the lower guide block 30 has the guide surface 29 bent into a concave shape from the right end toward the upper end. Also, the lower guide block 30 includes the fold back member 28 which folds back the tension member 27 at the lower side of the screen mounting frame 10. In contrast, the upper fold back member 28 is attached to a position slightly lower than the upper end of the main body 10*a* of the screen mounting frame 10.

The upper slide guide frame portion 15 and the lower slide guide frame portion 16 are accommodated in the interior of the main body 10*a* of the screen mounting frame 10 in association with the sideward sliding movement of the screen mounting frame 10, and are also withdrawn therefrom. Portions withdrawn from the screen mounting frame 10 are maintained linearly by the first rigid units 24 and the second rigid units 17 configured as described above.

Incidentally, since the lower slide guide frame portion 16 is retracted into the interior of the main body 10*a* from below the screen mounting frame 10, the retracting direction is opposite from the direction of gravitational force. Therefore, a weight 31 is connected to the free end 26 thereof. The weight 31 applies its own weight to a portion of the lower slide guide frame portion 16 raising upward from the bottom, and when the lower slide guide frame portion 16 is withdrawn from the screen mounting frame 10, the lower slide guide frame portion 16 is pushed out in moderation. Also, when the lower slide guide frame portion 16 is retracted into the interior of the main body 10*a* of the screen mounting frame 10, the entry of the lower slide guide frame portion 16 is suppressed in moderation. Therefore, the lower slide guide frame portion 16 is retracted into and withdrawn from the interior of the main body 10*a* of the screen mounting frame 10 in a smooth and stable manner.

Then, in the upper slide guide frame portion 15 and the lower slide guide frame portion 16, the sizes of the first rigid units 24 and those of the second rigid units 17 are different.

The size of the first rigid units 24, which constitute the upper slide guide frame portion 15, is smaller than the size of the second rigid units 17, which constitute the lower slide guide frame portion 16 in all dimensions, namely, lateral width, depth, and height. Therefore, in the screen device 1, when the upper slide guide frame portion 15 and the lower slide guide frame portion 16 are retracted into the interior of the main body 10*a* of the screen mounting frame 10, the side wall portions 18 of the first rigid units 24 are fitted into the inner side of the side wall portions 18 of the second rigid units 17, and the upper slide guide frame portion 15 intersects the lower slide guide frame portion 16 in the interior of the main body 10*a* of the screen mounting frame 10. Such an intersection allows application of the screen device 1 into the opening in the building, whose ratio of the width to the length is large, and allows flexible adaptation to the dimensions of the opening in the building.

Figure 3:
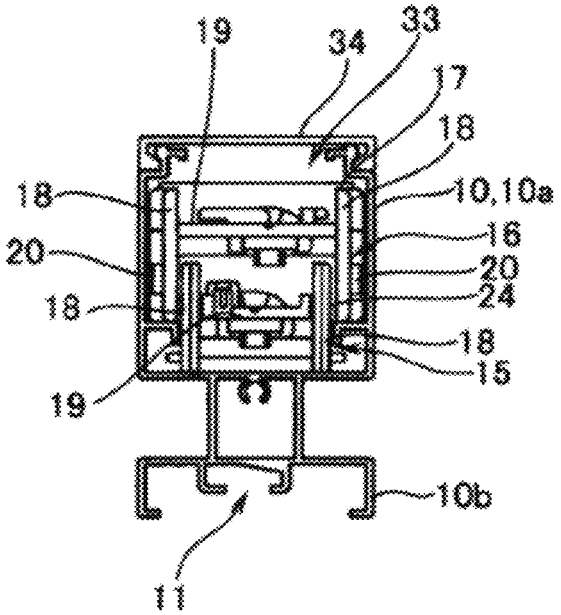
FIGS. 3(*a*) and 3(*b*) are cross-sectional views of a principle portion showing a state in which an upper slide guide frame portion and a lower slide guide frame portion of the screen device shown in FIG. 1 are retracted into a screen mounting frame, respectively.
Figure 3:
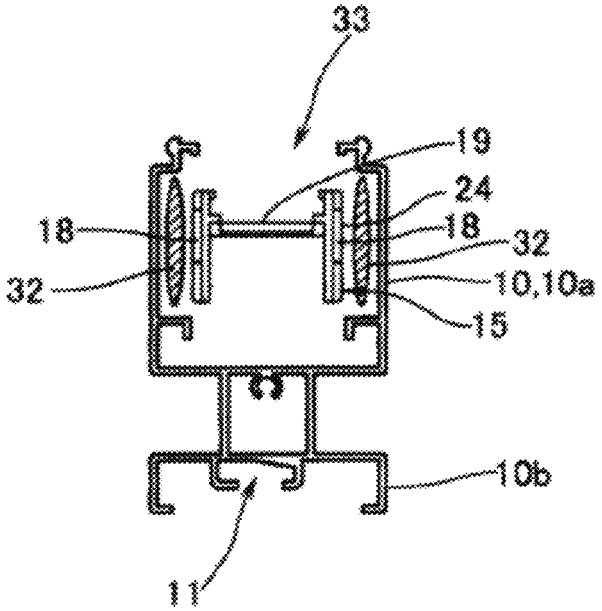
Figure 4:
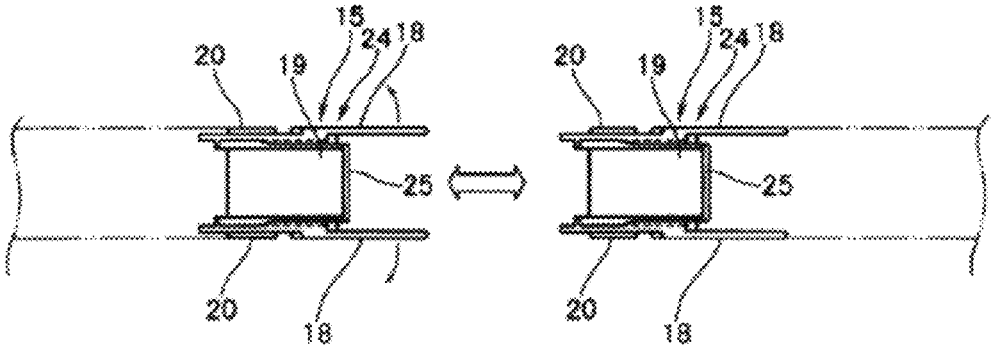
FIG. 4 is a plan view of a principal portion showing the upper slide guide frame portion shown in FIG. 3 with connection and disconnection of first rigid units.

Also, since the lower slide guide frame portion 16, made up of the larger second rigid units 17, can be retracted into the interior of the main body 10*a* of the screen mounting frame 10, the upper slide guide frame portion 15 made up of the smaller first rigid units 24 can be retracted into the interior of the main body 10*a* of the screen mounting frame 10 with a space allowance 32 with respect to the main body 10*a* of the screen mounting frame 10 as shown in FIG. 3(*b*). Therefore, connection between the first rigid units 24 can be released by inserting a tool such as a screw driver into the interior of the main body 10*a* of the screen mounting frame 10.

Connection of the first rigid units can be released at an arbitrary position in the interior of the screen mounting frame when adjusting the length of a screen device 1 and the upper slide guide frame portion can be taken out from the screen mounting frame, so that adjustment of the length of the screen device is facilitated. The screen device 1 needs adjustment of the length in the field of installation according to the size of the opening in the building as described above. In the length adjustment work in this case, upper end portions of the screen mounting frame 10, the screen 2 and the roller pipe 3 are cut. However, if the upper slide guide frame portion 15 is disposed in the vicinity of the upper end of the screen 2 at this time, the upper slide guide frame portion 15 works against the length adjustment work. In the screen device 1, as described above, since the upper slide guide frame portion 15 is retracted into the interior of the main body 10*a* of the screen mounting frame 10 with the space allowance 32 with respect to the main body 10*a* of the screen mounting frame 10, the upper slide guide frame portion 15 can be taken out from the interior of the main body 10*a* of the screen mounting frame 10 by releasing the connection between the first rigid units 24 at the time of the length adjustment work.

The main body 10*a* of the screen mounting frame 10 is formed with an opening 33 on the front surface portion opposing the door stop frame 12, and the interior of the main body 10*a* is openable toward the outside. A cover 34 is detachably attached to the opening 33 on the front surface portion of the main body 10*a*. Therefore, by removing the cover 34, the tool such as the screw driver can be inserted into the interior of the main body 10*a* through the opening 33. Also, insertion of the tool can be performed at an arbitrary position in the range of the length of the main body 10*a* of the screen mounting frame 10.

In this manner, in the screen device 1, when adjustment of the length by cutting in the field of installation is required, the upper slide guide frame portion 15 can be taken out from the screen mounting frame 10 by releasing the connection between the first rigid units 24 and, taking out of the upper slide guide frame portion 15 can be easily performed at an arbitrary position in the range of the length of the main body 10*a* of the screen mounting frame 10. The length adjustment work on the screen device 1 is facilitated.

Also, as described above, in the screen device 1, the fold back member 28 for folding back the tension member 27 on the upper side of the screen mounting frame 10 is mounted to a position slightly lower than the upper end of the main body 10*a* of the screen mounting frame 10. Therefore, the upper fold back member 28 can be arranged on the lower side with respect to the cutting position of the screen device 1. Therefore, cutting of the screen mounting frame 10 on the upper end side is enabled without removing the tension member 27 from the fold back member 28. The tension member 27 does not work against the length adjustment work of the screen device 1, and it is not necessary to detach the upper fold back member 28 once and reattach the same to the screen mounting frame 10. The length adjustment work on the screen device 1 can be performed easily.

Incidentally, assembly of the upper slide guide frame portion 15 after the length adjustment work and attachment of the same into the interior of the main body 10*a* of the screen mounting frame 10 can be performed easily in the reverse order of the taking out operation.

In addition, intersection of the upper slide guide frame portion 15 with the lower slide guide frame portion 16, which enables release of connection between the first rigid units 24 as described above can be realized easily, for example, by arranging the guide surface 29 of the upper guide block 30 disposed on the upper end portion of the screen mounting frame 10 on the side of the screen mounting portion 10*b* with respect to the guide surface 29 of the guide block 30 disposed on the lower side.

In addition, in the screen device 1, since the upper ends of the screen 2 and the roller pipe 3 are arranged at the same position as described above, the main body 3*a* of the roller pipe 3 can be cut at a time together with the screen 2. As described above, the revolving shaft 5 does not exist at a portion on the upper end side in the main body 3*a* of the roller pipe 3. The upper end side of the main body 3*a* of the roller pipe 3 can be cut because it is a simple hollow pipe. Also, by aligning the upper end of the screen mounting frame 10 with the upper end of the screen 2, the screen mounting frame 10 can also be cut at the same time. In this manner, the length adjustment work of the screen device 1 is further facilitated.

In addition, in the screen device 1, an upper end of the housing frame 9, which accommodates the roller pipe 3 therein, is also arranged at the same position as the upper end of the roller pipe 3. In other words, the upper ends of the screen 2, the roller pipe 3 and the housing frame 9 are arranged in alignment at the same position indicated by the arrow X in FIG. 1. Therefore, at the time of length alignment work, the housing frame 9 including the roller pipe 3 can be cut in a state of accommodating the roller pipe 3 in the interior thereof at the same time together with the screen 2. Therefore, the length adjustment work of the screen device 1 is further facilitated.

Also, in the screen device 1, as shown in FIG. 1, a latch 35 is disposed on the door stop frame 12, which is disposed on the left architrave B extending in the vertical direction of the opening in the building so as to face the screen mounting frame 10. The latch 35 includes an engaging portion 36 projecting toward the screen mounting frame 10 and bent downward, and the latch 35 is movable in the vertical direction by an action of an elastic force of a spring 37 attached thereto. Also provided is a hanger 39 having an opening 38 that engages the engaging portion 36 disposed on the front surface portion of the screen mounting frame 10 which faces the latch 35. The hanger 39 is fixed to the front surface portion of the main body 10*a* with a screw or the like in the same manner as the cover 34 at the opening 33 formed on the front surface portion on the main body 10*a* of the screen mounting frame 10 shown in FIGS. 3(*a*)-(*b*).

When closing the screen 2, if the screen mounting frame 10 is slid to the door stop frame 12, the engaging portion 36 of the latch 35 enters the opening 38 of the hanger 39, and the distal end thereof is caught by and engages the hanger 39 at an edge portion of the opening 38. With this engagement, the screen mounting frame 10 is restricted from moving against the elastic force of the coil spring 6 integrated in the roller pipe 3, and the screen device 1 can be kept in the closed state stably.

Figure 5:
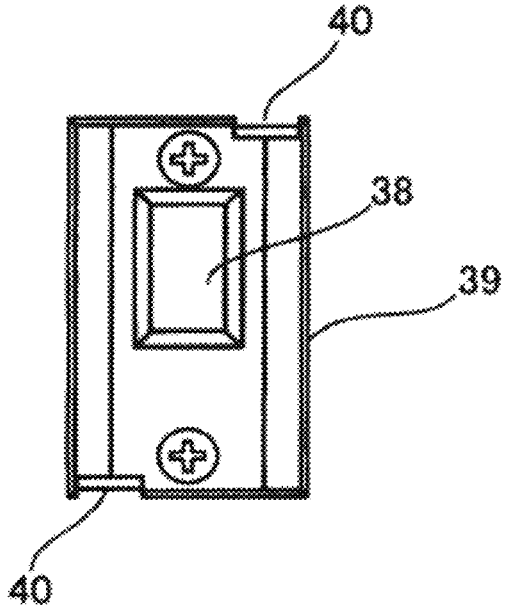
FIG. 5 is a front view of a hanger disposed in the screen device shown in FIG. 1.

Then, in the screen device 1, insertion grooves 40 which allow insertion of the tool such as a screw driver are formed by cutting both upper and lower end portions of the hanger 39 on the outer side of the hanger 39 as shown in FIG. 5.

Therefore, by inserting the tool such as the screw driver into the insertion groove 40, the cover 34 attached to the opening 33 on the main body 10*a* of the screen mounting frame 10 and positioned on the upper and lower sides of the hanger 39 can be detached easily. The cover 34 is detached by being pushed by the distal end of the tool inserted into the interior of the main body 10*a* through the insertion groove 40 toward the front from the back surface side of the cover 34. Therefore, when taking out the upper slide guide frame portion 15 from the interior of the main body 10*a* of the screen mounting frame 10 in the length adjustment work of the screen device 1, the cover 34 can be detached easily and hence the length adjustment work of the screen device 1 can further be facilitated.

Figure 6:
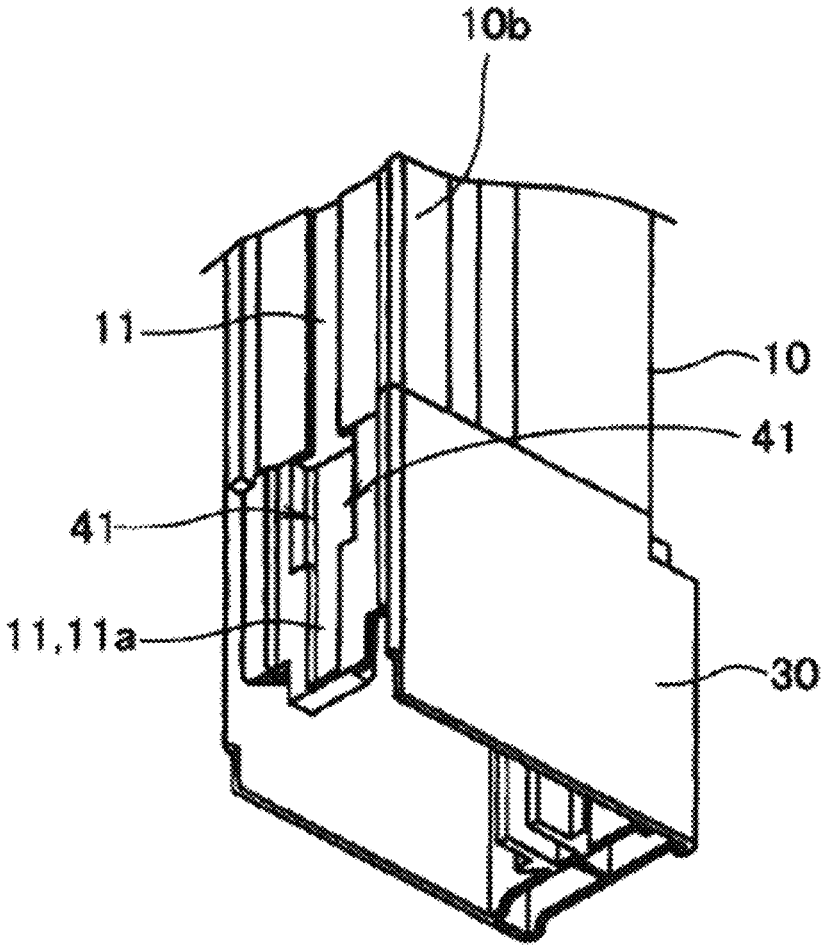
FIG. 6 is a perspective view of a principal portion showing a lower end portion of the screen mounting frame of the screen device shown in FIG. 1 on the side of a screen mounting portion.
Figure 7:
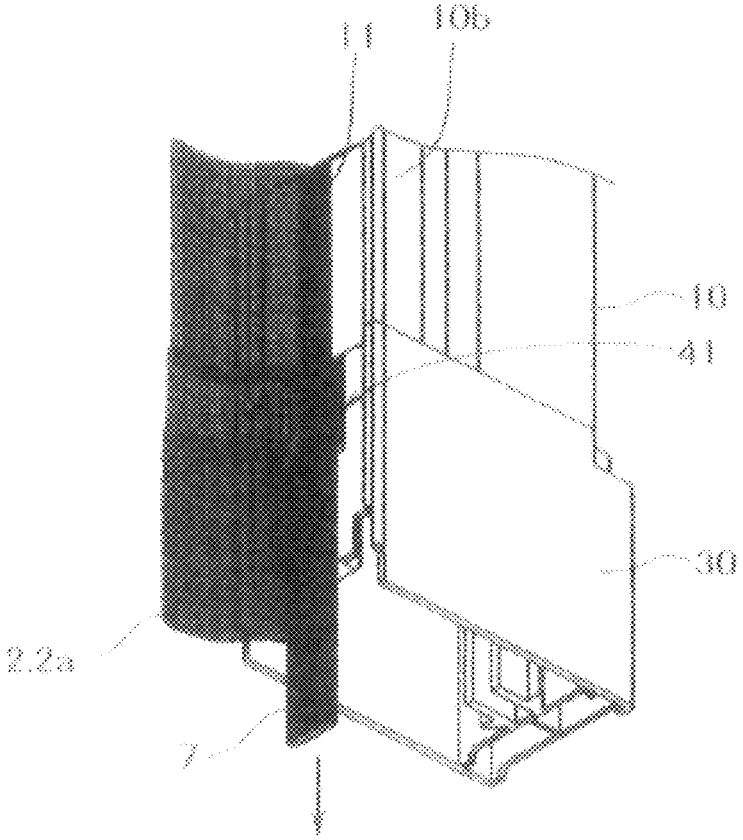
FIG. 7 is a perspective view of a principal portion corresponding to FIG. 6, showing an operation to pull down the screen when cutting the length of the screen device shown in FIG. 1.

FIG. 6 is a perspective view of a principal portion showing a lower end portion of the screen mounting frame of the screen device shown in FIG. 1 on the side of the screen mounting portion. FIG. 7 is a perspective view of a principal portion corresponding to FIG. 6, showing an operation to pull down the screen at the time of the length adjustment work on the screen device shown in FIG. 1.

In the screen device 1, the slot 11 formed on the side of the screen mounting portion 10*b* of the screen mounting frame 10 is notched on both the left and right sides so as to increase in width at the lower end portion of the screen mounting frame 10, whereby notches 41 are formed. The notches 41 are formed on the guide block 30 connected to the lower end of the main body 10*a* of the screen mounting frame 10 along a slot 11*a* extending collinearly with the slot 11 formed on the main body 10*a*.

With the formation of the notches 41, the tool such as the screw driver can be inserted into the interior of the slot 11*a* through the notches 41. Therefore, when performing the length adjustment work on the screen device 1, the fixing member 7 disposed on the left end portion of the screen 2 can be pulled downward by inserting the tool such as the screw driver into the interior of the slot 11*a* through the notches 41. When the fixing member 7 is pulled down, the screen 2 is also pulled down correspondingly, so that the main body 10*a* of the screen mounting frame 10 can be moved relatively upward with respect to the screen 2.

The guide block 30, configured to guide the retraction and withdrawal of the upper slide guide frame portion 15, is connected to the upper end of the main body 10*a* of the screen mounting frame 10 as described above. When performing the length adjustment work on the screen device 1, it is necessary to cut the upper end side of the main body 10*a* of the screen mounting frame 10, and the upper guide block 30 is detached at the time of cutting. Therefore, the upper end of the main body 10*a* arranged at a position indicted by an arrow Y in FIG. 1 and the upper end of the screen 2 can be aligned easily at the same position by the relative upward movement of the screen mounting frame 10. Cutting of the main body 10*a* of the screen mounting frame 10 can be performed together with the screen 2, and the upper ends of the screen 2 and the main body 3*a* of the roller pipe 3 are arranged at the same position as described above. Therefore, the upper end of the main body 10*a* of the screen mounting frame 10 can be aligned at the same position as the upper end of the main body 3*a* of the roller pipe 3. Therefore, the upper ends of the main body 10*a* of the screen mounting frame 10, the screen 2, and the main body 3*a* of the roller pipe 3 are aligned and hence can be cut at the same time. The length adjustment work on the screen device 1 is further facilitated.

Incidentally, pulling down of the fixing member 7 is facilitated because the notches 41 are formed on both the left and right sides of the slot 11*a*. When the notch 41 is formed only on one of the left and right sides, it is difficult to pull down the fixing member 7 smoothly because the width of the slot 11 is limited to a size required for the insertion of the fixing member 7.

Figure 8:
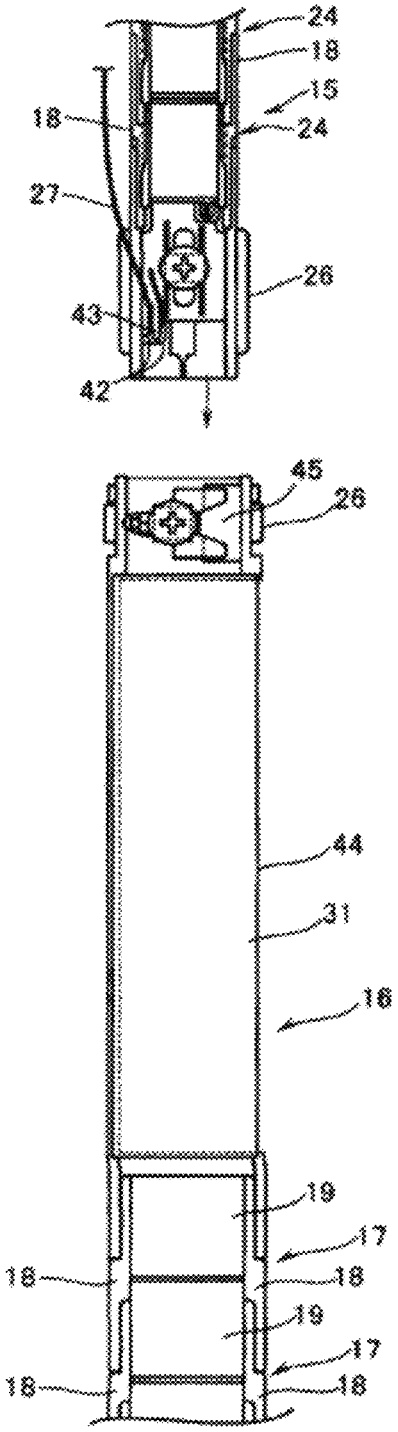
FIG. 8 is a front view of a principal portion showing an arrangement of a tension member for connecting the upper slide guide frame portion and the lower slide guide frame portion in the screen device shown in FIG. 1.

FIG. 8 is a front view of a principal portion showing an arrangement of the tension member 27 for connecting the upper slide guide frame portion 15 and the lower slide guide frame portion 16 in the screen device 1.

The arrangement of the tension member 27 is performed in the interior of the main body 10*a* of the screen mounting frame 10. Two grooves 42 are formed at the free end 26 of the upper slide guide frame portion 15 at a position near the distal end in the retracting direction so as to be adjacent to each other on the left and right sides, and a hook 43 is disposed between the grooves 42. The tension member 27 is fixed to the free end 26 of the upper slide guide frame portion 15 at one end thereof, is drawn into the right groove 42, laid along the back side of the hook 43, is drawn out to the near side from the right groove 42, then is arranged along the direction of the length of the upper slide guide frame portion 15. In this state, the fixed side of the tension member 27 is engaged with the free end 26.

In contrast, the lower slide guide frame portion 16 includes an end unit 44 having the weight 31 integrated therein at the free end 26 thereof. An opening 45 penetrating in the fore-and-aft direction is formed on the end unit 44 at a position near the distal end in the direction of retracting the lower slide guide frame portion 16.

When assembling the upper slide guide frame portion 15 and the lower slide guide frame portion 16 in the interior of the main body 10*a* of the screen mounting frame 10, as described above, the side wall portions 18 of the first rigid units 24, which constitute the upper slide guide frame portion 15, are fitted into the inside of the side wall portions 18 of the second rigid units 17, which constitute the lower slide guide frame portion 16, so that the upper slide guide frame portion 15 and the lower slide guide frame portion 16 intersect with respect to each other. Distribution of the tension member 27 is achieved by drawing the tension member 27 to the near side of the lower slide guide frame portion 16 through an opening 45 when causing the free end 26 of the upper slide guide frame portion 15 to intersect with the free end 26 of the lower slide guide frame portion 16. Since the tension member 27 is engaged with the free end 26 at the fixed side thereof with respect to the upper slide guide frame portion 15, the upper slide guide frame portion 15 can be retracted into the interior of the main body 10*a* of the screen mounting frame 10 without the necessity to lay the hand thereon when assembling the upper slide guide frame portion 15 into the interior of the main body 10*a* of the screen mounting frame 10. Then, the tension member 27 can be drawn out to the near side of the lower slide guide frame portion 16 by inserting the tool such as the screw driver through the opening 45 formed on the free end 26 of the lower slide guide frame portion 16 by hauling in the tension member 27. The tension member 27, drawn out to the near side of the lower slide guide frame portion 16, can be laid along the direction of the length of the lower slide guide frame portion 16, wound around the pulley 28*a* of the lower fold back member 28 and fixed to the free end 26 of the lower slide guide frame portion 16. In the same manner, the tension member 27, distributed along the direction of length of the upper slide guide frame portion 15, can be wound around the pulley 28*a* of the upper fold back member 28 and fixed to the free end 26 of the lower slide guide frame portion 16.

In this manner, in the screen device 1, distribution of the tension member 27 is also facilitated.

Although the present invention has been described along the embodiment, the present invention is not limited to the embodiment. Various detailed configurations and structures of the respective portions may be selected as needed considering functions which are to be carried out by respective portions.

REFERENCE NUMERALS

1 screen device
2 screen
3 roller pipe
6 coil spring
7 fixing member
10 screen mounting frame
11, 11*a* slot
15 upper slide guide frame portion
16 lower slide guide frame portion
17 second rigid unit
18 side wall portion
19 bridging portion
24 first rigid unit
26 free end
27 tension member
28 fold back member
35 latch

39 hanger
40 insertion groove
41 notch
B architrave

The invention claimed is:

1. A screen device comprising:

a screen that is opened and closed in a sideward direction;

a roller pipe fixed in a predetermined position, wherein one of a left end and a right end of the screen is attached to the roller pipe which is configured to be rotated by an elastic force of an integrated coil spring and wind the screen on an outer periphery thereof;

a screen mounting frame which is slidable in the direction of opening and closing of the screen with respect to the roller pipe, wherein the emend of the screen, which is positioned on the opposite side from the end attached to the roller pipe, is attached to the screen mounting frame, and an opening is formed along a length of the screen mounting frame, the opening being located at an opposite side relative to a side of the screen mounting frame at which the end of the screen is attached;

an upper slide guide frame portion disposed in the vicinity of an upper end of the screen; and a lower slide guide frame portion disposed in the vicinity of a lower end of the screen, wherein:

the upper slide guide frame portion is made up of a plurality of first rigid units, each having a pair of side wall portions arranged so as to face each other and a bridging portion connecting the side wall portions to each other, the first rigid unit being connected so as to permit relative rotation between adjacent first rigid units, the lower slide guide frame portion is made up of a plurality of second rigid units, each having a pair of side wall portions arranged so as to face each other and a bridging portion connecting the side wall portions to each other, the second rigid units being connected so as to permit relative rotation between adjacent second rigid units, the upper slide guide frame portion and the lower slide guide frame portion both have flexibility and each have a free end at one end thereof, the free end being able to be retracted into and withdrawn from an interior of the screen mounting frame so that portions withdrawn from the screen mounting frame in association with the sliding movement of the screen mounting frame maintain their linearity when being withdrawn from the screen mounting frame, each of the first rigid units has a projection at a first end of each of the sidewall portions, a through hole at a second end of each of the sidewall portions, and a shoulder formed on an edge portion of the bridging portion, the adjacent first rigid units are connected by inserting the projections of one of the adjacent first rigid units into the through holes of the other of the adjacent first rigid units, the upper side guide frame portion is configured so that the upper side guide frame portion is refracted into the interior of the screen mounting frame with a space allowance, which permits the connection between the adjacent first rigid units to be released by inserting a tool into the interior of the screen mounting frame, the upper slide guide frame portion is removable from the screen mounting frame by inserting the tool through the opening into the interior of the screen mounting frame and releasing the connection between two adjacent first rigid units, each of the second rigid units has a projection at a first end of each of the sidewall portions, a through hole at a second end of each of the sidewall portions, a smaller projection that projects outwardly from an end of each of the projections, and an elongated hole formed at an end of each of the through holes, the adjacent second rigid units are connected by inserting the projections of one of the adjacent second rigid units into the through holes of the other of the adjacent second rigid units, and the smaller projections of the one of the adjacent second rigid units into the elongated holes of the other of the adjacent second rigid units, and each of the first rigid units is of a size that is smaller than a size of each of the second rigid units, and when the upper slide guide frame portion and the lower slide guide frame portion are retracted into the interior of the screen mounting frame, the side wall portions of the first rigid units are fitted into inner sides of the side wall portions of the second rigid units, and the upper slide guide frame portion intersects the lower slide guide frame portion in the interior of the screen mounting frame.

2. The screen device according to claim 1, wherein a latch is disposed on an architrave facing the screen mounting frame at an opening where the screen device is installed, a hanger configured to engage the latch on a front surface portion of the screen mounting frame facing the architrave is installed, and the hanger is formed with insertion grooves for a tool at both upper and lower end portions thereof.

3. The screen device according to claim 1, wherein the shoulder is formed by notching an end edge portion of the bridging portion; and, upon connection of the adjacent first rigid units, a first end portion of the bridging portion of one of the adjacent first rigid units overlaps the shoulder formed on a second end edge portion of the bridging portion of the other of the adjacent first rigid units to restrict rotation between the two adjacent first rigid units.

4. The screen device according to claim 1, further comprising a cover removably attached to the opening formed along the length of the screen mounting frame.

5. The screen device according to claim 1, wherein the screen mounting frame includes a slot which allows insertion of a fixing member disposed at an end portion of the screen at a position where the screen is mounted, and the slot is formed with notches formed by cutting both left and right sides thereof so as to increase the width thereof at a lower end portion of the screen mounting frame.

6. The screen device according to claim 5, wherein a latch is disposed on an architrave facing the screen mounting frame at an opening where the screen device is installed, a hanger configured to engage the latch on a front surface portion of the screen mounting frame facing the architrave is installed, and the hanger is formed with insertion grooves for a tool at both upper and lower end portions thereof.

7. The screen device according to claim 5, wherein:

the roller pipe includes a hollow main body and a bearing connected at an end portion of the main body;

a revolving shaft is disposed in an interior of the main body, and the revolving shaft extends from the bearing to a midpoint of the main body in a height direction of the roller pipe;

the integrated coil spring is arranged around the revolving shaft; and an upper end of the screen and an upper end of the roller pipe are arranged at the same position.

8. The screen device according to claim 7, wherein a latch is disposed on an architrave facing the screen mounting frame at an opening where the screen device is installed, a hanger configured to engage the latch on a front surface portion of the screen mounting frame facing the architrave is installed, and the hanger is formed with insertion grooves for a tool at both upper and lower end portions thereof.

9. The screen device according to claim 1, wherein the free ends of the upper slide guide frame portion and the lower slide guide frame portion are connected by a tension member forming a loop in the interior of the screen mounting frame, fold back members for folding back the tension member are disposed at upper and lower positions in the interior of the screen mounting frame, and the upper fold back member is arranged at a position that is lower than a cutting position of the screen device.

10. The screen device according to claim 9, wherein a latch is disposed on an architrave facing the screen mounting frame at an opening where the screen device is installed, a hanger configured to engage the latch on a front surface portion of the screen mounting frame facing the architrave is installed, and the hanger is formed with insertion grooves for a tool at both upper and lower end portions thereof.

11. The screen device according to claim 9, wherein the screen mounting frame includes a slot which allows insertion of a fixing member disposed at an end portion of the screen at a position where the screen is mounted, and the slot is formed with notches formed by cutting both left and right sides thereof so as to increase the width thereof at a lower end portion of the screen mounting frame.

12. The screen device according to claim 11, wherein a latch is disposed on an architrave facing the screen mounting frame at an opening where the screen device is installed, a hanger configured to engage the latch on a front surface portion of the screen mounting frame facing the architrave is installed, and the hanger is formed with insertion grooves for a tool at both upper and lower end portions thereof.

13. The screen device according to claim 11, wherein:

the roller pipe includes a hollow main body and a bearing connected at an end portion of the main body;

a revolving shaft is disposed in an interior of the main body, and the revolving shaft extends from the bearing to a midpoint of the main body in a height direction of the roller pipe;

the integrated coil spring is arranged around the revolving shaft; and an upper end of the screen and an upper end of the roller pipe are arranged at the same position.

14. The screen device according to claim 13, wherein a latch is disposed on an architrave facing the screen mounting frame at an opening where the screen device is installed, a hanger configured to engage the latch on a front surface portion of the screen mounting frame facing the architrave is installed, and the hanger is formed with insertion grooves for a tool at both upper and lower end portions thereof.

* * * * *